United States Patent [19]

Mygatt, Jr. et al.

[11] 4,027,775

[45] June 7, 1977

[54] TAMPER-INDICATING CONTAINER AND LID THEREFOR

[75] Inventors: Leonard T. Mygatt, Jr., Wallingford, Pa.; Edward E. Goldsmith, Passaic, N.J.

[73] Assignee: National Packaging Associates Corporation, Wallingford, Pa.

[22] Filed: May 28, 1975

[21] Appl. No.: 581,577

[52] U.S. Cl. ..... 220/266; 220/306; 215/253

[51] Int. Cl.[2] ..... G65D 41/32

[58] Field of Search ..... 220/266, 267, 268, 269, 220/270, 276, 306, DIG. 21; 215/256, 253; 150/.5

[56] References Cited

UNITED STATES PATENTS

| | | | |
|---|---|---|---|
| 2,837,236 | 1/1958 | Betner | 220/266 |
| 2,941,660 | 6/1960 | Tupper | 150/.5 X |
| 2,998,158 | 8/1961 | Tupper | 220/276 |
| 3,027,045 | 3/1962 | Wilson | 206/505 |
| 3,572,579 | 3/1971 | Mueller | 150/.5 X |
| 3,716,162 | 2/1973 | Botkin | 220/266 |
| 3,817,420 | 6/1974 | Heisler | 220/276 |
| 3,858,748 | 1/1975 | Marco | 220/276 |
| 3,913,771 | 10/1975 | Action | 215/256 |

*Primary Examiner*—William Price
*Assistant Examiner*—Joseph Man-Fu Moy

[57] ABSTRACT

A guard flange extends about the sidewall of the container immediately below and outwardly beyond the skirt of the lid, with weakened portions of the guard flange providing a removable section thereof which may be broken away to unshield a portion of the lid's skirt and permit removal of the lid.

13 Claims, 7 Drawing Figures

TAMPER-INDICATING CONTAINER AND LID THEREFOR

This invention relates to container and lid combinations of the tamper-indicating type, and preferably the reusable kind which are frequently employed for packaging prepared foods and other products.

BACKGROUND OF THE INVENTION

Lids and containers molded on resilient plastic material, such as polyethylene and polypropylene, are convenient, economical, and effective. The lid and container combination may be made reusable whereby the lid may be replaced and removed again and again after the first opening. Although reusability is a convenience for the user, there is a risk that tamperers, thieves or mishaps may lift the lid, contaminate or remove some of the contents, and replace the lid without leaving visible evidence of removal, unless provision is made to indicate otherwise. In the case of containers for foods and some other products, such provision in tamper-indicating container and lid combinations has become necessary or highly desirable in order to protect the consumer.

Various kinds of tamper-indicating containers are in current use. One type has a thin, transparent membrane closing the mouth of the container, and frequently is further provided with a lid which covers the membrane and is secured to the rim of the container. Another type includes a seal bridging adjacent portions of the lid and the container and which is secured to such respective adjacent portions. Still another type has a tear strip interconnected to the lid and extending about the sidewall of the container below an annular bulge in the container, whereby the lid cannot be removed without breaking the interconnection between the tear strip and the lid.

As indication of tampering is provided by the present invention without requiring a membrane at the mouth of the container, without the need for a seal bridging the lid and the container, and without a tear strip interconnected to the lid. Yet, the convenience of reusability is retained together with the effectiveness and economy afforded by molding the separate lids and containers of resilient plastic material.

SUMMARY OF THE INVENTION

In the container and lid combination of the present invention much is of conventional construction. The container includes a continuous sidewall having at its upper end a rim forming an open mouth adapted to receive and retain the lid, but permitting removal and replacement of the lid. The lid includes a central portion for closing the mouth of the container, and it further includes a peripheral skirt which extends downwardly from the periphery of the central portion and firmly engages the exterior of the container entirely along the peripheral surface portion of the container below its rim. According to the invention, a guard flange is formed about the sidewall of the container at an elevation immediately below the bottom edge of the skirt of the lid. The guard flange extends outwardly away from the sidewall beyond the skirt, thus shielding it from forces which would remove the lid. The guard flange includes a removable section which may be removed to unshield an adjacent portion of the skirt and thereby permit removal of the lid. A broken or missing removable section of the guard flange indicates prior removal of the lid or conditioning of the container for removal of the lid.

In one embodiment of the invention the removable section is made by providing a first weakened part in the guard flange, preferably an undercut in the guard flange where it joins the sidewall, establishing an interconnection of greatly reduced cross section between the guard flange and the sidewall. In addition, one or more second weakened parts are provided between the removable and non-removable sections of the guard flange, desirably at opposite ends of the removable section. The second weakened part is preferably established by means of a radially extending slot between the end of the removable section and the adjacent end of the non-removable section, but which terminates short of a thin interconnection between the removable and non-removable sections at the outer edge of the guard flange.

In a second embodiment of the invention, the first weakened part may be omitted, and a series of second weakened parts are closely spaced together throughout the removable section. It follows that the removable section in this embodiment of the invention is established by means of a series of closely spaced, radial slots in the guard flange.

The removable section of the first embodiment is characterized by a length of guard flange which is easily broken away from the sidewall and the non-removable portion of the guard flange, whereas the second embodiment may be seen as having a removable section comprised of fragile elements which are easily broken off from the sidewall and from one another as well as the rest of the flange.

BRIEF DESCRIPTION OF THE DRAWINGS

In the drawings wherein like reference characters denote like parts in the several views.

DESCRIPTION OF THE PREFERRED EMBODIMENTS

Figure 1:
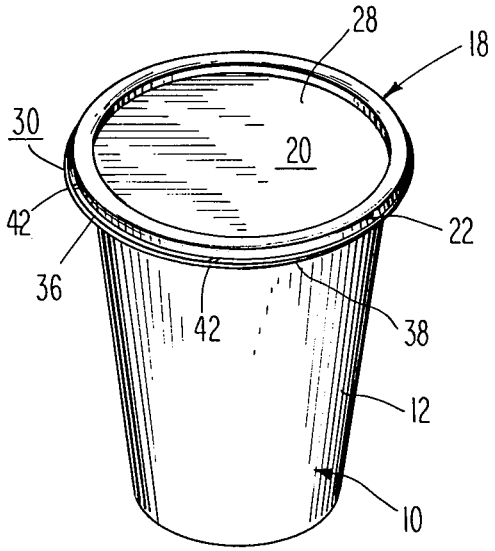
FIG. 1 is a perspective view of a container and lid therefor embodying the invention.

As shown in the drawings, the container 10 has a continuous sidewall of circular cross section formed about a vertical axis. The sidewall 12 has at its upper end a rim 14 forming an open mouth, immediately below which is a peripheral or annular bulge 16 on the exterior surface. The sidewall 12 tapers downwardly, terminating in a closed, flat bottom. Preferably the container 10 is made of resilient plastic material such as polyethylene or polypropylene; however the invention may be practiced with other materials and other cross-sectional configurations.

The lid 18 conforms to the shape of the top of the container 10, being comprised of a central portion 20 for removably closing the mouth of the container and also having a peripheral skirt 22. The skirt 22 extends downwardly from the periphery of the central portion 20 and firmly or snugly engages the exterior of the container below the rim 14. The bottom edge of the skirt 22 is designated by the numeral 24. The skirt 22 is also provided with an inwardly extending peripheral or annular lip 26 which snugly engages the lower surface portion of the bulge 16 on the container, an interlocking relationship being established because the lip 26 and the bulge 16 overlap one another in radial directions that are generally normal to the outer surface of the container 10. This interlocking relationship helps to secure the lid 18 to the top of the container 10.

Although the lip 26 resists movement past the bulge 16, it is still possible with manual force to remove the lid 18 from the container because the lid is preferably made of the same resilient plastic material as the container 10, and the lip will therefore stretch and dilate during the removal procedure. In order to reduce the possibility of inadvertent removal of the lid 18, its central portion 20 is further provided with a depressed inner portion 28 which is depressed to approximately the level of the bulge 16 in the assembled position of the lid and the container. Moreover, the outside diameter of the inner portion 28 is made slightly larger than the inside diameter of the container surface it engages, this interference fit ensuring further that the bulge 16 is biased outwardly into locking engagement with the lip 26. The lid just described is of the reusable type which lends itself to removal by hand, with the fingers gripping the bottom edge 24 of the lid 18, and to replacement by positioning the lid on the container and pushing downwardly on the lid until the lip again interlocks with the bulge. A sealing relationship between the lid and the container is established with the lid properly seated, through tight engagement of the rim 14 with that portion of the inner surface of the lid disposed between the inner portion 28 and the skirt 22.

Figure 2:
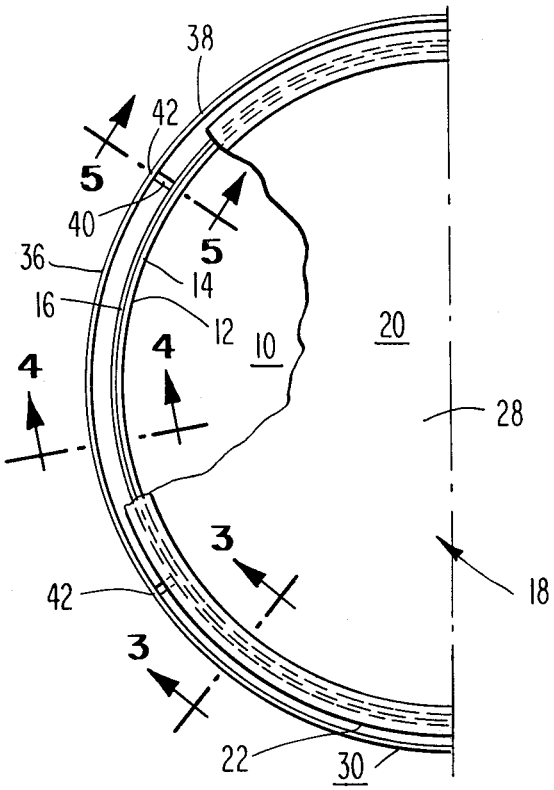
FIG. 2 is a partial top view, on an enlarged scale, of the container and lid shown in FIG. 1.
Figure 4:
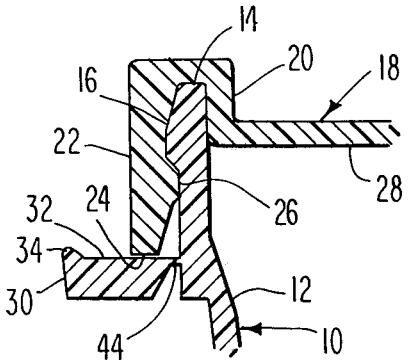
FIG. 4 is a fragmentary vertical sectional view, taken diametrically of the container along line 4—4 of FIG. 2.
Figure 3:
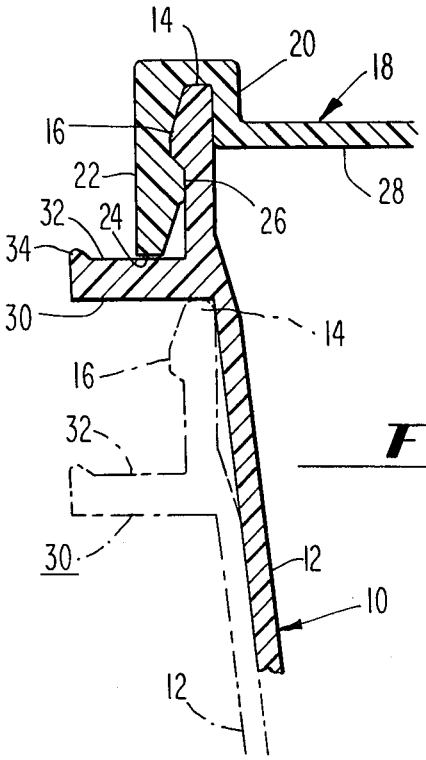
FIG. 3 is a vertical sectional view, taken diametrically of the container along line 3—3 of FIG. 2, with an additional container illustrated in broken lines in nested relationship.

As best seen in FIGS. 2 and 3, an annular guard flange 30 is formed on the sidewall 12 of the container 10, preferably by molding them integrally together. It is to be noted that the top surface 32 of the guard flange is immediately below the bottom edge 24 of the skirt 22, with an extremely small clearance or no clearance between them, since it is intended to prevent removal of the lid by preventing gripping contact with the bottom edge 24. As shown, the guard flange 30 extends radially outwardly from the sidewall 12 well beyond the skirt 22, thus shielding the bottom edge 24 of the lid from lifting forces or at least the application thereof to such bottom edge. Although shielding may be effected if the guard flange 30 extends outwardly to the outer extent of the skirt 22, it is desirable if the outward extent of the flange 30 is in the order of twice the outward extent of the skirt 22, or more, in order to provide even more effective shielding and also to facilitate proper removal of the lid, as will be described.

Referring to FIG. 3, the guard flange is of generally rectangular cross section, but with the addition of a small raised lip or bead 34 along the entire top surface 32 at the outer periphery of the guard flange. As will be seen, the bead 34 provides a gripping edge and also serves in the structure of the tamper-indicating device of the present invention.

The rim 14, the inner surface of the lip 26, the outer surface of the bulge 16, the outer surface of the skirt 22, and the outer surface of the guard flange 30 are all circular; and they are of increasing diameter in the order named.

In the embodiment of FIGS. 1 to 5, the guard flange 30 is provided with a removable section 36 for a minor portion, say one-fifth, of its circumference, with the remainder being designated a non-removable section 38. According to the invention, the removable section 36 will be easily broken away from the sidewall 12 and the non-removable section 38, so that the lid 18 may then be partly unshielded at the bottom edge 24 for removal, all with manual hand or finger forces; and the breakage or removal of the removable section is the tamper-indicating feature. A downward force on the removable section is all that is required to break it away.

Figure 5:
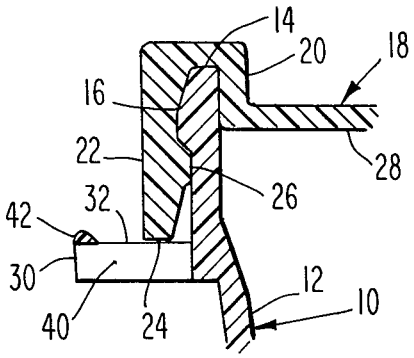
FIG. 5 is a view similar to FIG. 4, taken along line 5—5 of FIG. 2.

As shown in FIGS. 2 and 5, a radially extending slot 40 is formed at opposite ends of the removable section 36, thus providing a gap in the order of 1/16 inch between the removable and non-removable sections, cutting through the thickness of the flange 30 from the sidewall 12 to the outer edge of the flange 30 but not through the bead 34 of about 0.015 inch thickness which bridges the gap at each slot 40 to interconnect adjacent sections 36 and 38. So much of the bead 34 which bridges the slot 40 serves as the weakened part of the removable section 36 which must be broken to remove the removable section 36, and is designated by 42.

A second weakened part 44 of removable section 36 is an undercut portion thereof interconnecting with the sidewall 12. The undercut in the flange of about 0.050 inches thickness reduces this second weakened part to about 0.005 inches thickness, and renders it easy to separate from the sidewall 12 during the procedure of removing the removable section 36. The present invention may be practiced by providing one slot 40 and an undercut second weakened part 44, but it is recommended that two slots 40 be provided as illustrated.

In FIG. 3 it is shown that the guard flange 30 underlies the rim 14, so that with a downwardly tapering sidewall 12 it is possible to stack containers in nested relationship, with the guard flange of the upper container resting on the rim of the lower container throughout the entire stack.

MODIFICATIONS

Figure 6:
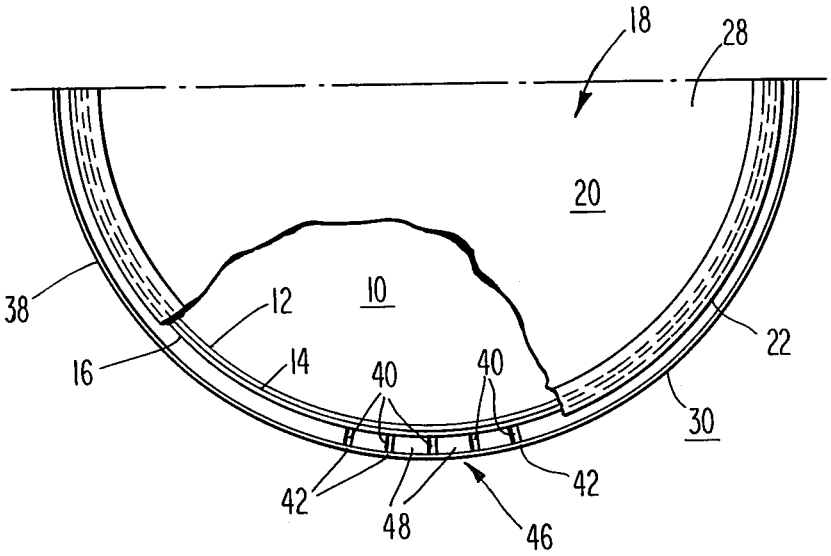
FIG. 6 is a view similar to FIG. 2 of a modified form of the invention.
Figure 7:
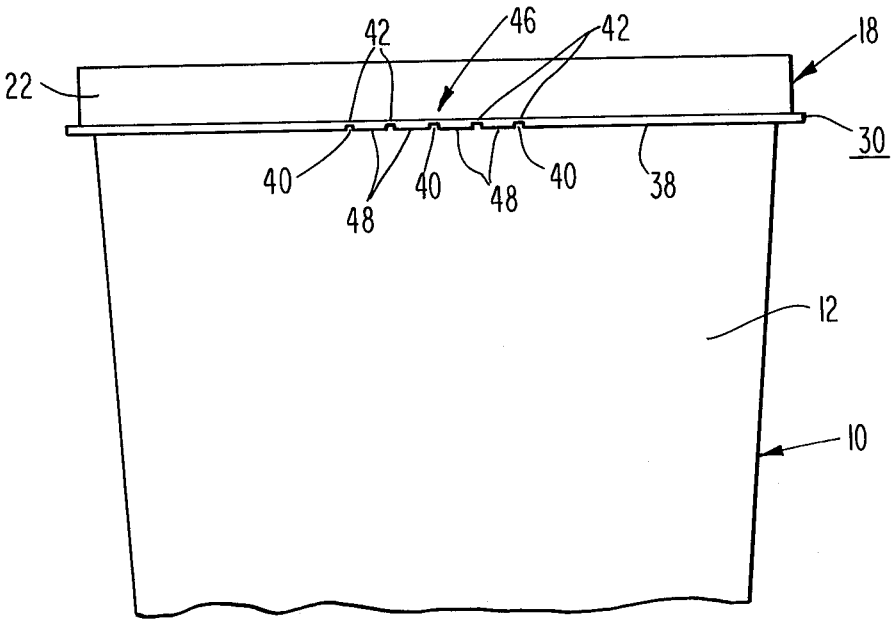
FIG. 7 is an elevational view of the container and lid of FIG. 6.

In the embodiment of FIGS. 6 and 7, like reference numerals are employed to designate correspondingly similar parts which have been described previously herein. For the sake of brevity, it is to be understood that the lids 18 of both embodiments are identical, and that the containers are similar. The differences between the containers 10 reside in the removable sections. Therefore, the reference numeral 46 is employed to designate the removable section of the embodiment of FIGS. 6 and 7.

The removable section 46 is comprised of a plurality of weakened parts 42 formed by a closely spaced series of radially extending slots 40. Unlike the previous embodiment where the slots 40 are provided only at the ends of the removable section 36, in the present embodiment the slots 40 are closely spaced, about ¼ to ⅜ inch apart in a small (1 pint) to medium (1 quart) size container and in the order of ½ inch apart in the larger sizes. Furthermore, there are preferably a minimum of 4 or 5 slots 40 arranged in series in a removable section 46. Thus, with a guard flange 30 having a thickness of about 0.050 inches and a radial extent in the order of 3/16 to ¼ inch, the slots 40 define weakened parts 48 between them which are relatively slender in radial direction. Moreover, the weakened parts 48 are interconnected with one another and the non-removable section 38 by means of weakened bridge parts 42 remaining from the bead 34 which is not cut by the slots 40. In other words, the removable section 46 alternately comprises radial sections through the flange 30 similar to FIGS. 5 and 3, repeating in series four, five or more times throughout the arcuate length of the removable section.

With this arrangement, an array of weakened parts 48 extend outwardly from the sidewall in cantilever fashion, and they are interconnected transversely by weakened bridge parts of thin cross section designated by the numeral 42. The bridge parts 42 bridge the slots 40 and interconnect the parts 48 and the non-removable section 38. Downward finger pressure on the removable section 46 will break the bridge parts 48 where they are joined to the sidewall 12; and it will also break some or all of the weakened bridge parts 42. With the removable section 46 broken away, the bottom edge 24 of the skirt 22 is accessible to fingers and fingernails whereas it was previously shielded, and it is next possible to remove the lid 18.

With either embodiment of the invention, the container and lid combination is reusable, and a tamper-indicating feature may be added without sacrificing the effectiveness, convenience or economy expected of this product.

Although the preferred embodiments have been disclosed, it is understood that the invention is not limited to precise details. Rather, it is susceptible of various changes without departing from the scope of the following claims.

What is claimed is:

1. A tamper-indicating container and lid combination, comprising a container including a continuous sidewall having at its upper end a rim forming an open mouth; a lid including a central portion for removably closing the mouth of said container, and having a peripheral skirt extending downwardly from the periphery of said central portion and firmly engaging the exterior of said container below said rim; and that improvement comprising a guard flange formed about said sidewall and integrally therewith immediately below said skirt, with small clearance or no clearance between said guard flange and the bottom edge of said skirt, said guard flange extending away from said sidewall outwardly beyond said skirt whereby said guard flange shields the bottom edge of said skirt from forces which would otherwise remove said lid, said guard flange including a minor portion thereof comprising a removable section having a weakened part and a major portion thereof comprising a non-removable section, whereby said removable section may be removed to unshield a portion of said bottom edge of said skirt and thereby permit removal of said lid, and the non-removable section of guard flange being retained to guard a major portion of the bottom edge of said skirt if said lid is replaced during reuse of said container.

2. The combination according to claim 1 wherein said container and said lid are made of resilient plastic material, said non-removable section being interconnected to said removable section by a bridge part of said weakened part.

3. The combination according to claim 1 wherein said non-removable section is interconnected to said removable section by said weakened part, and further including a second weakened part between said removable section and said sidewall, whereby a downward force on said removable section tears said weakened part and separates said removable section from said sidewall along said second weakened part.

4. The combination according to claim 1 wherein said removable section is comprised of a plurality of weakened parts formed between radially extending slots in said guard flange.

5. The combination according to claim 4 wherein said weakened parts are slender in radial direction, with said slots being closely spaced apart, and further including second weakened parts of thin cross section interconnecting said first weakened parts with one another and a non-removable section of said guard flange, said second weakened parts bridging said respective slots.

6. The combination according to claim 1 wherein the container is provided with a peripheral bulge below said rim and above the level of the lower end of said skirt, said bulge extending outwardly from said sidewall, said skirt including a peripheral lip extending inwardly toward said sidewall for interlocking engagement with the lower surface portion of said bulge, said bulge and said lip being in overlapping relationship in directions normal to said sidewall, whereby said skirt is releasably held against removal past said bulge by the resistance of said lip.

7. The combination according to claim 6 wherein said sidewall, said rim, said skirt, said guard flange, said bulge, and said lip are of annular cross section.

8. The combination according to claim 7 wherein said rim, the inner surface of said lip, the outer surface of said bulge, the out4er surface of said skirt, and the outer surface of said guard flange are of increasing diameter in the order named.

9. The combination according to claim 1 wherein said sidewall tapers downwardly from said rim and the guard flange underlies said rim, whereby a plurality of empty containers without lids may be stacked upright in nested relationship with the guard flange of each nested container resting on the rim of the next lower container.

10. The combination according to claim 1 wherein the vertical distance between the guard flange and the rim of an upright container is equal to or greater than the vertical dimension of said skirt on the inner surface thereof.

11. The combination according to claim 6 wherein the central portion of said lid is provided with a depressed inner portion disposed below the level of said rim, with the periphery of said inner portion engaging the inner surface of said container at approximately the level of said bulge.

12. The combination according to claim 11 wherein the rim of said container engages the lid between the inner portion and the skirt in sealing relationship.

13. The combination according to claim 1 wherein said weakened part is disposed at both ends of said removable section.

* * * * *